US011105198B2

(12) United States Patent
Dumont et al.

(10) Patent No.: US 11,105,198 B2
(45) Date of Patent: Aug. 31, 2021

(54) METHODS FOR IN-SITU MULTI-TEMPERATURE MEASUREMENTS USING DOWNHOLE ACQUISITION TOOL

(71) Applicant: Schlumberger Technology Corporation, Sugar Land, TX (US)

(72) Inventors: Hadrien Dumont, Houston, TX (US); Christopher Harrison, Auburndale, MA (US); Youxiang Zuo, Burnaby (CA); Christopher Albert Babin, Waveland, MS (US); Li Chen, Katy, TX (US); Vinay K. Mishra, Katy, TX (US); German Garcia, Katy, TX (US); Abhishek Agarwal, Sugar Land, TX (US); Matthew T. Sullivan, Westwood, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 194 days.

(21) Appl. No.: 15/087,770

(22) Filed: Mar. 31, 2016

(65) Prior Publication Data

US 2017/0284197 A1 Oct. 5, 2017

(51) Int. Cl.

| | |
|---|---|
| ***E21B 49/10*** | (2006.01) |
| ***E21B 47/07*** | (2012.01) |
| ***E21B 49/08*** | (2006.01) |

(52) U.S. Cl.

CPC ..... *E21B 49/10* (2013.01); *E21B 47/07* (2020.05); *E21B 49/0875* (2020.05)

(58) Field of Classification Search

CPC ..... E21B 49/08–49/10; G01N 33/28–33/30

See application file for complete search history.

(56) References Cited

U.S. PATENT DOCUMENTS

| | | | |
|---|---|---|---|
| 4,690,216 | A | 9/1987 | Pritchard, Jr. |
| 5,691,809 | A | 11/1997 | Tackett et al. |
| 6,755,079 | B1 | 6/2004 | Proett et al. |
| 8,335,650 | B2 | 12/2012 | Hsu et al. |
| 8,564,768 | B2 | 10/2013 | Schroeder et al. |

(Continued)

FOREIGN PATENT DOCUMENTS

WO WO2014158376 A1 10/2014

*Primary Examiner* — George S Gray
(74) *Attorney, Agent, or Firm* — Trevor G. Grove

(57) ABSTRACT

Methods for obtaining in-situ, multi-temperature measurements of fluid properties, such as saturation pressure and asphaltene onset pressure include obtaining a sample of formation fluid using a downhole acquisition tool positioned in a wellbore in a geological formation. The downhole acquisition tool may be stationed at a first depth in the wellbore that has an ambient first temperature. While stationed at the first depth, the downhole acquisition tool may test a first fluid property of the sample to obtain a first measurement point at approximately the first temperature. The downhole acquisition tool may be moved to a subsequent station at a new depth with an ambient second temperature, and another measurement point obtained at approximately the second temperature. From the measurement points, a temperature-dependent relationship of the first fluid property of the first formation fluid may be determined.

8 Claims, 6 Drawing Sheets

(56) References Cited

U.S. PATENT DOCUMENTS

| | | | | |
|---|---|---|---|---|
| 8,910,514 | B2 | 12/2014 | Sullivan et al. | |
| 9,303,510 | B2 | 4/2016 | Dumont et al. | |
| 2010/0263442 | A1* | 10/2010 | Hsu | E21B 49/088 73/152.55 |
| 2012/0024050 | A1 | 2/2012 | Godager | |
| 2012/0145400 | A1 | 6/2012 | Harrison et al. | |
| 2013/0111985 | A1 | 5/2013 | Veeningen | |
| 2013/0219997 | A1* | 8/2013 | Sullivan | E21B 49/10 73/53.01 |
| 2013/0243028 | A1* | 9/2013 | Singh | G01N 33/2823 374/43 |
| 2015/0309002 | A1* | 10/2015 | Fukagawa | G01N 33/2835 356/70 |
| 2016/0362977 | A1 | 12/2016 | Feng et al. | |
| 2017/0175524 | A1 | 6/2017 | Dumont et al. | |

* cited by examiner

METHODS FOR IN-SITU MULTI-TEMPERATURE MEASUREMENTS USING DOWNHOLE ACQUISITION TOOL

BACKGROUND

This disclosure relates to measuring properties of formation fluid at various temperatures downhole using a downhole acquisition tool.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Reservoir fluid analysis may be used in a wellbore in a geological formation to locate hydrocarbon-producing regions in the geological formation, as well as to manage production of the hydrocarbons in these regions. A downhole acquisition tool may carry out reservoir fluid analysis by drawing in formation fluid and testing the formation fluid downhole or collecting a sample of the formation fluid to bring to the surface. The downhole acquisition tool may include various devices, such as probes and/or packers, that may be used to isolate a desired region of the wellbore (e.g., at a desired depth) and establish fluid communication with the subterranean formation surrounding the wellbore. The probe may draw the formation fluid into the downhole acquisition tool, and direct the formation fluid to one or more fluid analyzers and sensors. The fluid analyzers and sensors may measure fluid properties of the formation fluid. The hydrocarbon-producing regions in the geological formation may be located based on the measured fluid properties of the formation fluid.

In certain downhole fluid analysis applications, saturation pressure (PSAT) and asphaltene onset pressure (AOP) of the formation fluid may be tested or estimated. The PSAT of the formation fluid generally describes a relationship between temperature and pressure at which the formation fluid changes phase between liquid and gas. As such, it is sometimes also referred to as the "bubble point" for a liquid, or a "dew point" for a gas. The AOP of the formation fluid generally describes a relationship between temperature and pressure at which the formation fluid begins to precipitate asphaltene components.

The downhole acquisition tool may estimate the PSAT and AOP of the formation fluid by collecting a sample of the formation fluid and measuring various fluid properties (e.g., optical density, density, gas-to-oil ratio, pressure, temperature, among others) of the sample. One technique involves obtaining a sample at the bottom of a well and measuring its properties as the downhole acquisition tool is pulled out of the wellbore. Since temperature tends to increase with well depth, the temperature tends to gradually decrease as the downhole acquisition tool is pulled out. As a result, some temperature/pressure coordinates that relate to the PSAT and the AOP of the sample of the formation fluid may be identified. The PSAT and AOP points measured in this way may be used for phase envelope modeling of the formation fluid in an equation of state. Since the PSAT and AOP also tend to vary by temperature, the accuracy of the phase envelope modeling of the formation fluid in the equation of state may depend on the particular temperatures of the measurements while the downhole acquisition tool is being pulled out of the well. Moreover, although this technique may provide some PSAT and AOP measurements for one sample of formation fluid from the well, various depths in the well may have formation fluids with different respective properties for which knowledge of the PSAT and AOP may be valuable.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

This disclosure relates to obtaining in-situ, multi-temperature measurements of fluid properties, such as saturation pressure and asphaltene onset pressure. In one example, a sample of formation fluid is obtained using a downhole acquisition tool positioned in a wellbore in a geological formation. The downhole acquisition tool may be stationed at a first depth in the wellbore that has an ambient first temperature. While stationed at the first depth, the downhole acquisition tool may test a first fluid property of the sample to obtain a first measurement point at approximately the first temperature. The downhole acquisition tool may be moved to a subsequent station at a new depth with an ambient second temperature, and another measurement point obtained at approximately the second temperature. From the measurement points, a temperature-dependent relationship of the first fluid property of the first formation fluid may be determined.

In another example, one or more tangible, machine-readable media may include instructions to receive a first set of measurement values of a first temperature-dependent fluid property of a first formation fluid measured in-situ by a downhole acquisition tool, and fit the first set of measurement values to a first curve. The first set of measurement values may be obtained while the downhole acquisition tool is located at different respective depths, each of which has a different respective ambient temperature. This may cause the measurement values to be measured at corresponding different respective temperatures. The first curve may fit the measurement values to the first temperature-dependent fluid property over a range of temperatures including the different respective temperatures.

In another example, a method includes obtaining a sample of a first formation fluid from a first fluid zone in a wellbore using a downhole acquisition tool and obtaining a sample of a second formation fluid from a second fluid zone in the wellbore using the downhole acquisition tool. At each of a number of stations at different depths in the wellbore having different respective ambient temperatures, fluid testing may be performed on at least part of the sample of the first formation fluid and on at least part of the sample of the second formation fluid. Based on the fluid testing, a first temperature-dependent relationship of a first fluid property of the first formation fluid and a second temperature-dependent relationship of the first fluid property of the second formation fluid may be identified.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
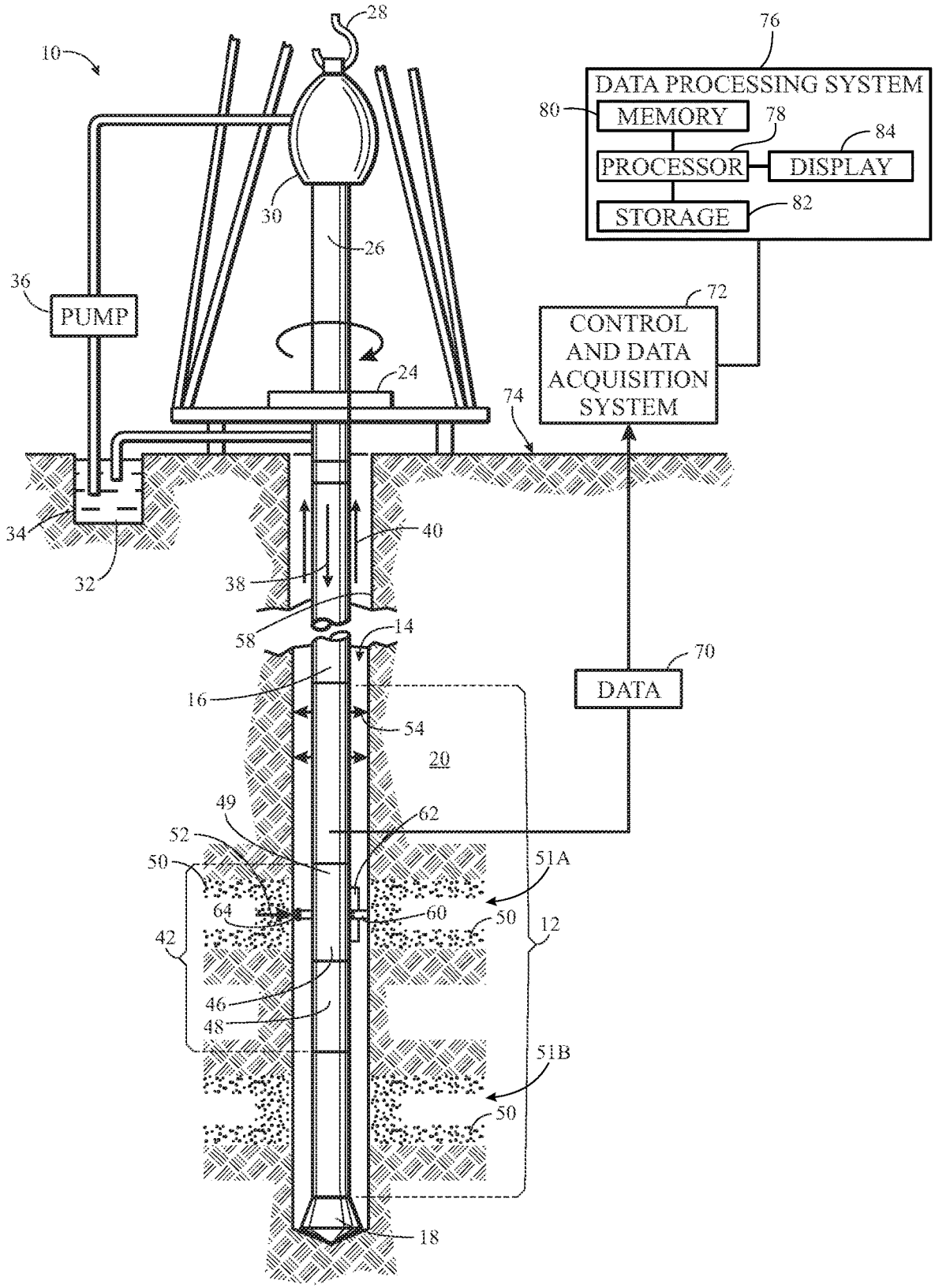
FIG. 1 is a schematic diagram of a well site system that may be used to identify multiple points of a phase envelope of a formation fluid, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Acquisition and analysis of representative formation fluid samples downhole in delayed or real time may be useful for determining the economic value of hydrocarbon reserves and oil field development. A downhole acquisition tool may acquire formation fluid and test the formation fluid to determine and/or estimate phase temperature/pressure data points of envelopes. For example, the downhole acquisition tool pressure saturation (PSAT), asphaltene onset pressure (AOP), and/or wax appearance temperature (WAT) may be tested on several different samples at multiple temperatures in-situ. For example, the downhole acquisition tool may measure one or more fluid properties (e.g., optical density, density, gas-to-oil ratio, viscosity, among others) of various samples of formation fluid that were obtained at different depths. By testing the samples for PSAT, AOP, and/or WAT at several different depths, the particular pressure values where these phase envelopes occur may be ascertained for a variety of different temperatures. This may provide a more complete measurement of the phase envelopes at a variety of depths. As a result, a more accurate model of the formation fluids may be obtained for phase envelope modeling and/or to generate phase diagrams of the formation fluid.

It may be valuable to obtain more accurate measurements of phase envelopes of formation fluids from different depths. Indeed, one way in which formation fluids from different fluid zones may vary from their individual formation fluid components may be the phase envelopes that describe the behavior of the mixed fluid. Phase envelopes may be diagrammatically represented as curves relating pressure and temperature. On different sides of the curve, the formation fluid may have different phase behavior. For example, a saturation pressure (PSAT) phase envelope describes the temperature and pressures delineating liquid vs. gas behavior. When the formation fluid is at a temperature and pressure above the PSAT phase envelope, the formation fluid may be substantially gas-free, but when the formation fluid is at a temperature and pressure on the other side of the PSAT phase envelope, gas bubbles may begin to form in the formation fluid. In another example, an asphaltene onset pressure (AOP) phase envelope describes the temperature and pressures delineating the appearance of asphaltene components in the formation fluid. When the formation fluid is at a temperature and pressure above the AOP phase envelope, the formation fluid may be substantially free of asphaltenes, but when the formation fluid is at a temperature and pressure on the other side of the AOP phase envelope, asphaltene components may begin to fall out of solution in the formation fluid.

Accurately modeling the phase envelopes of the formation fluids may be tremendously valuable for hydrocarbon exploration and production. Indeed, as formation fluids are produced, the formation fluids may experience a range of temperatures and pressures. As a formation fluid is produced, the temperatures and pressures of the well may gradually decrease. At some point, the temperatures and pressures may reach a "bubble point" when the fluid breaks phase at the saturation pressure (PSAT), producing gaseous and liquid phases. In addition, the formation fluid may break phase in the formation itself during production. For example, one zone of the formation may contain oil with dissolved gas. During production, the formation pressure may drop to the extent that the bubble point pressure is reached, allowing gas to emerge from the oil, causing production concerns. At times, too, the formation fluid may experience changes in pressure and temperature that cause asphaltenes to begin to appear, which could result in production-choking "tar mats." Thus, accurate modeling of the phase envelopes may be very helpful when designing production strategies.

Moreover, other fluid properties may also change with temperature and pressure. As noted above, the temperature tends to decrease as the fluid is transiting from the wellbore bottom to the surface. This tends to increase the fluid viscosity as the formation fluid is being extracted. To accurately calculate the flow rate during production, an accurate estimate of the viscosity may be useful.

Rather than, or in addition to, measuring the PSAT, AOP, and/or WAT properties of a formation fluid just at the depth where it was collected, or by measuring only a single sample as the downhole acquisition tool is pulled out from the well, the systems and methods of this disclosure may obtain samples of formation fluids at different depths and measure properties related to their phase envelopes at multiple different depths—and thus multiple different temperatures in-situ. In one example, formation fluids may be sampled at different stations and stored in different chambers. At several different depths, part of the formation fluid from each of the different samples may be tested to identify PSAT, AOP, and/or WAT at the temperature that naturally occurs at that depth using a pressure-volume-temperature (PVT) tester. By collecting multiple data points identifying the PSAT, AOP, and/or WAT at multiple different temperatures, more accurate models of the phase envelopes (which may vary with temperature and pressure) of the formation fluid samples may be ascertained. Additionally or alternatively, the downhole acquisition tool may test the PSAT, AOP, and/or WAT of a mixture of formation fluids from different stations at different depths and, accordingly, different temperatures.

Figure 2:
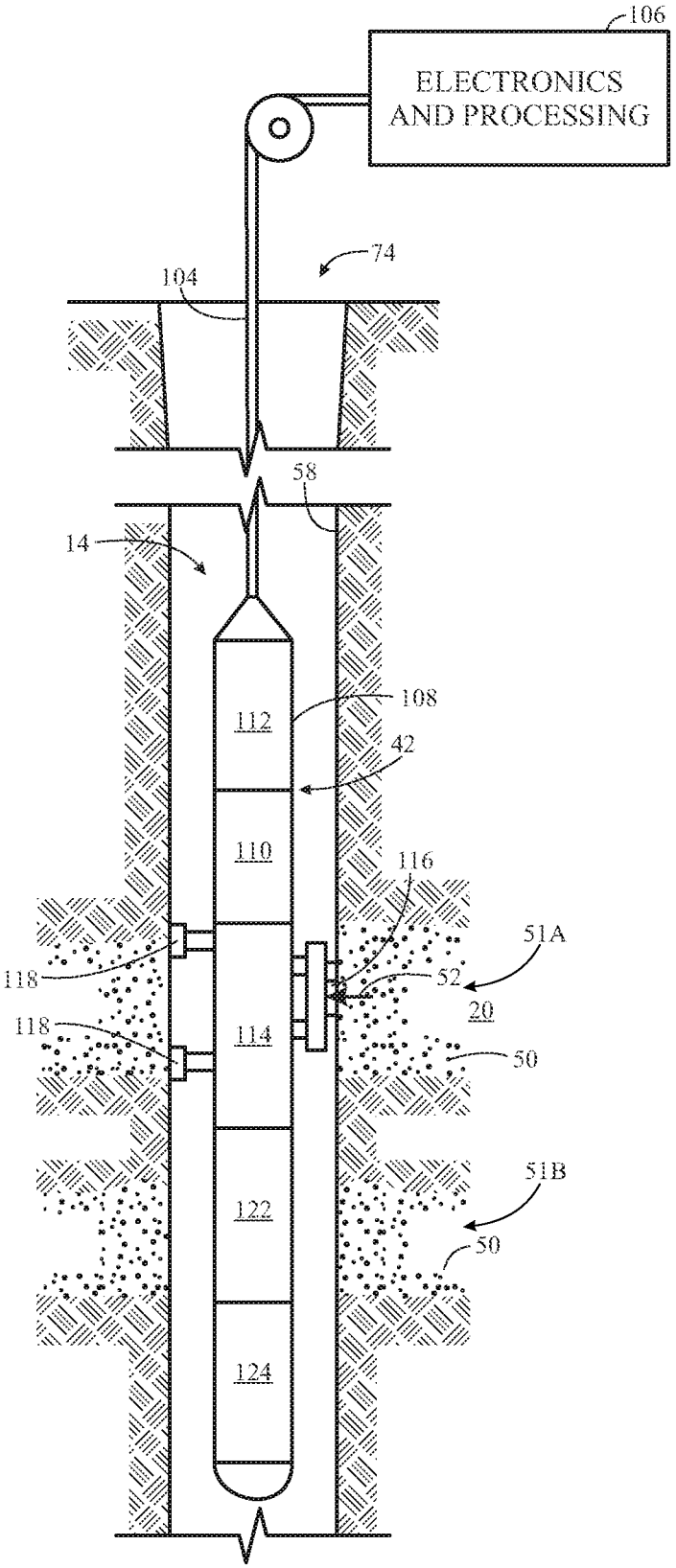
FIG. 2 is a schematic diagram of another example of a well site system that may be used to identify multiple points of a phase envelope of a formation fluid, in accordance with an embodiment.

FIGS. 1 and 2 depict examples of wellsite systems that may employ such fluid analysis systems and methods. In FIG. 1, a rig 10 suspends a downhole acquisition tool 12 into a wellbore 14 via a drill string 16. A drill bit 18 drills into a geological formation 20 to form the wellbore 14. The drill string 16 is rotated by a rotary table 24, which engages a kelly 26 at the upper end of the drill string 16. The drill string 16 is suspended from a hook 28, attached to a traveling block, through the kelly 26 and a rotary swivel 30 that permits rotation of the drill string 16 relative to the hook 28. The rig 10 is depicted as a land-based platform and derrick assembly used to form the wellbore 14 by rotary drilling. However, in other embodiments, the rig 10 may be an offshore platform.

Drilling fluid referred to as drilling mud 32, is stored in a pit 34 formed at the wellsite. A pump 36 delivers the drilling mud 32 to the interior of the drill string 16 via a port in the swivel 30, inducing the drilling mud 32 to flow downwardly through the drill string 16 as indicated by a directional arrow 38. The drilling mud 32 exits the drill string 16 via ports in the drill bit 18, and then circulates upwardly through the region between the outside of the drill string 16 and the wall of the wellbore 14, called the annulus, as indicated by directional arrows 40. The drilling mud 32 lubricates the drill bit 18 and carries formation cuttings up to the surface as it is returned to the pit 34 for recirculation.

The downhole acquisition tool 12, sometimes referred to as a component of a bottom hole assembly ("BHA"), may be positioned near the drill bit 18 and may include various components with capabilities such as measuring, processing, and storing information, as well as communicating with the surface. Additionally or alternatively, the downhole acquisition tool 12 may be conveyed on wired drill pipe, a combination of wired drill pipe and wireline, or other suitable types of conveyance.

The downhole acquisition tool 12 may further include a sampling system 42, which may include a fluid communication module 46, a sampling module 48, and a sample bottle module 49. In a logging-while-drilling (LWD) configuration, the modules may be housed in a drill collar for performing various formation evaluation functions, such as pressure testing and fluid sampling, among others, and collecting representative samples of native formation fluid 50. The example of FIG. 1 includes two fluid zones 51A and 51B where the native formation fluid 50 may enter the wellbore 14. The native formation fluid 50 from the fluid zones 51A and 51B may have different properties, particularly if the fluid zones 51A and 51B are hydraulically isolated from one another. As shown in FIG. 1, the fluid communication module 46 is positioned adjacent the sampling module 48; however the position of the fluid communication module 46, as well as other modules, may vary in other embodiments. Additional devices, such as pumps, gauges, sensors, monitors or other devices usable in downhole sampling and/or testing also may be provided. The additional devices may be incorporated into modules 46 or 48 or disposed within separate modules included within the sampling system 42.

The downhole acquisition tool 12 may evaluate fluid properties of an obtained fluid 52. Generally, when the obtained fluid 52 is initially taken in by the downhole acquisition tool 12, the obtained fluid 52 may include some drilling mud 32, some mud filtrate 54 on a wall 58 of the wellbore 14, and the native formation fluid 50. To isolate the native formation fluid 50, the downhole acquisition tool 12 may identify an amount of contamination that is likely present in the obtained fluid 52. When the contamination level is sufficiently low, the obtained fluid 52 may substantially represent uncontaminated native formation fluid 50. In this way, the downhole acquisition tool 12 may store a sample of the native formation fluid 50 or perform a variety of in-situ testing to identify properties of the native formation fluid 50. Accordingly, the sampling system 42 may include sensors that may measure fluid properties such as gas-to-oil ratio (GOR); mass density; optical density (OD); composition of carbon dioxide ($CO_2$), $C_1$, $C_2$, $C_3$, $C_4$, $C_5$, and/or $C_{6+}$; formation volume factor; viscosity; resistivity; conductivity, fluorescence; compressibility, and/or combinations of these properties of the obtained fluid 52. In on example, the sampling system 42 may include a pressure-volume-temperature (PVT) tester component that includes a volume that can change pressures using a piston or micro-piston. The PVT tester component may be used to identify a pressure where the fluid held in its volume crosses a phase envelope. The PVT tester component may operate as described by Application No. PCT/US2014/015467, which is incorporated by reference herein in its entirety for all purposes. In addition, the sampling system 42 may be used to monitor mud filtrate contamination to determine an amount of the drilling mud filtrate 54 in the obtained fluid 52. When the amount of drilling mud filtrate 54 in the obtained fluid 52 falls beneath a desired threshold, the remaining native formation fluid 50 may be stored as a sample and/or tested.

The fluid communication module 46 includes a probe 60, which may be positioned in a stabilizer blade or rib 62. The probe 60 includes one or more inlets for receiving the obtained fluid 52 and one or more flow lines (not shown) extending into the downhole tool 12 for passing fluids (e.g., the obtained fluid 52) through the tool. In certain embodiments, the probe 60 may include a single inlet designed to direct the obtained fluid 52 into a flowline within the downhole acquisition tool 12. Further, in other embodiments, the probe 60 may include multiple inlets (e.g., a sampling probe and a guard probe) that may, for example, be used for focused sampling. In these embodiments, the probe 60 may be connected to a sampling flowline, as well as to guard flow lines. The probe 60 may be movable between extended and retracted positions for selectively engaging the wellbore wall 58 of the wellbore 14 and acquiring fluid samples from the geological formation 20. One or more setting pistons 64 may be provided to assist in positioning the fluid communication device against the wellbore wall 58.

The sensors within the sampling system 42 may collect and transmit data 70 from the measurement of the fluid properties and the composition of the obtained fluid 52 to a control and data acquisition system 72 at surface 74, where the data 70 may be stored and processed in a data processing system 76 of the control and data acquisition system 72. The data processing system 76 may include a processor 78, memory 80, storage 82, and/or display 84. The memory 80 may include one or more tangible, non-transitory, machine readable media collectively storing one or more sets of instructions for operating the downhole acquisition tool 12 and estimating an amount of mud filtrate 54 in the obtained fluid 52. The memory 80 may store mixing rules and algorithms associated with the native formation fluid 50 (e.g., uncontaminated formation fluid), the drilling mud 32, and combinations thereof to facilitate estimating an amount of the drilling mud 32 in the obtained fluid 52. The data processing system 76 may use the fluid property and composition information of the data 70 to estimate an amount of the mud filtrate in the obtained fluid 52 and/or model phase envelopes or other properties of the obtained fluid 52. These may be used in one or more equations of state (EOS) models describing the obtained fluid 52 (e.g., the native formation fluid 50) or, more generally, a reservoir in the geological formation 20. Accordingly, more accurate estimates of the phase envelopes of the obtained fluid 52 may likely result in more accurate EOS models.

To process the data 70, the processor 78 may execute instructions stored in the memory 80 and/or storage 82. For example, the instructions may cause the processor 78 to estimate fluid and compositional parameters of the native formation fluid 50 of the obtained fluid 52, and control flow rates of the sample and guard probes, and so forth. As such, the memory 80 and/or storage 82 of the data processing system 76 may be any suitable article of manufacture that can store the instructions. By way of example, the memory 80 and/or the storage 82 may be ROM memory, random-access memory (RAM), flash memory, an optical storage medium, or a hard disk drive. The display 84 may be any suitable electronic display that can display information (e.g., logs, tables, cross-plots, etc.) relating to properties of the well as measured by the downhole acquisition tool 12. It should be appreciated that, although the data processing system 76 is shown by way of example as being located at the surface 74, the data processing system 76 may be located in the downhole acquisition tool 12. In such embodiments, some of the data 70 may be processed and stored downhole (e.g., within the wellbore 14), while some of the data 70 may be sent to the surface 74 (e.g., in real time or near real time).

FIG. 2 depicts an example of a wireline downhole tool 100 that may employ the systems and methods of this disclosure. The downhole tool 100 is suspended in the wellbore 14 from the lower end of a multi-conductor cable 104 that is spooled on a winch at the surface 74. Like the downhole acquisition tool 12, the wireline downhole tool 100 may be conveyed on wired drill pipe, a combination of wired drill pipe and wireline, or any other suitable conveyance. The cable 104 is communicatively coupled to an electronics and processing system 106. The downhole tool 100 includes an elongated body 108 that houses modules 110, 112, 114, 122, and 124, that provide various functionalities including fluid sampling, sample bottle filling, fluid testing, operational control, and communication, among others. For example, the modules 110 and 112 may provide additional functionality such as fluid analysis, resistivity measurements, operational control, communications, coring, and/or imaging, among others.

As shown in FIG. 2, the module 114 is a fluid communication module 114 that has a selectively extendable probe 116 and backup pistons 118 that are arranged on opposite sides of the elongated body 108. The extendable probe 116 selectively seals off or isolates selected portions of the wall 58 of the wellbore 14 to fluidly couple to the adjacent geological formation 20 and/or to draw fluid samples from the geological formation 20. For example, the probe 116 may obtain and store some native formation fluid 50 from the first fluid zone 51A and obtain and store some native formation fluid 50 from the second fluid zone 51B. The probe 116 may include a single inlet or multiple inlets designed for guarded or focused sampling. The native formation fluid 50 may be expelled to the wellbore 14 through a port in the body 108 or the obtained fluid 52, including the native formation fluid 50, may be sent to one or more fluid sampling modules 122 and 124. The fluid sampling modules 122 and 124 may include sample chambers that store the obtained fluid 52. In the illustrated example, the electronics and processing system 106 and/or a downhole control system are configured to control the extendable probe assembly 116 and/or the drawing of a fluid sample from the geological formation 20 to enable analysis of the obtained fluid 52. The sampling system 42 may obtain a variety of measurements that can be used to identify phase envelope boundaries of formation fluids 50.

Figure 3:
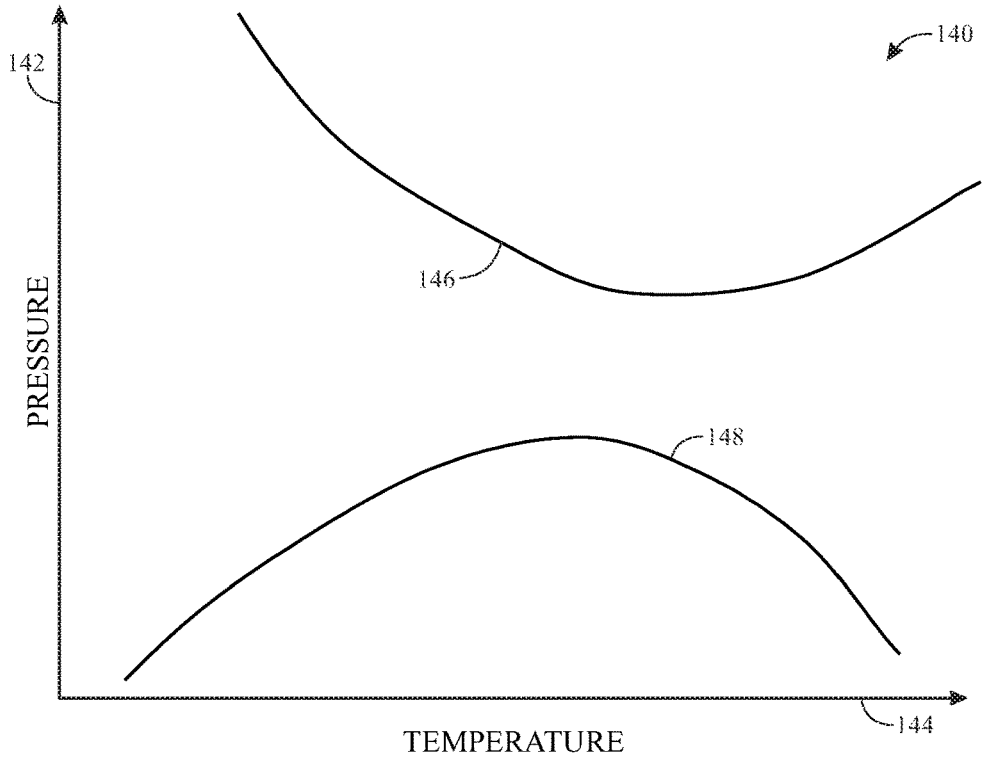
FIG. 3 is a plot of a phase diagram of formation fluid, in accordance with an embodiment.

A phase diagram 140 shown in FIG. 3 provides one example of phase envelopes that may describe a formation fluid 50. The phase diagram 140 describes behavior of the formation fluid 50 at various pressures (ordinate 142) and temperatures (abscissa 144). The phase envelopes represented in the phase diagram 140 include an asphaltene onset pressure (AOP) phase envelope 146 and a saturation pressure (PSAT) phase envelope 148. Other phase envelopes that may describe the behavior of the formation fluid 50, but which are not expressly shown in FIG. 3, include wax appearance temperature (WAT) and others relating to more exotic phases.

On different sides of the phase envelopes 146 and 148, the formation fluid 50 may have different phase behavior. For example, the saturation pressure (PSAT) phase envelope 148 describes the relationship between temperatures and pressure delineating liquid vs. gas behavior. When the formation fluid 50 is at a temperature and pressure above the PSAT phase envelope 148, the formation fluid 50 may be substantially gas-free, but when the formation fluid 50 is at a temperature and pressure beneath the PSAT phase envelope 148, gas bubbles may begin to form in the formation fluid 50. In another example, the asphaltene onset pressure (AOP)

phase envelope 146 describes the relationship between temperature and pressure delineating the appearance of asphaltene components in the formation fluid 50. When the formation fluid 50 is at a temperature and pressure above the AOP phase envelope 146, the formation fluid 50 may be substantially free of asphaltenes, but when the formation fluid 50 is at a temperature and pressure beneath the AOP phase envelope 146, asphaltene components may begin to fall out of solution in the formation fluid 50.

As mentioned above, the sampling systems 42 of the downhole tool 12 or the downhole tool 100 may perform pressure-volume-temperature (PVT) testing that can ascertain certain data points on the phase envelopes for saturation pressure (PSAT), asphaltene onset pressure (AOP), and/or other indications of phase envelope behavior of fluids, such as wax appearance temperature (WAT). Other fluid properties of the fluids may also be obtained in-situ, including fluid viscosity, density, composition, gas-to-oil ratio (GOR), differential vaporization, and so forth.

For example, the sampling system 42 may perform PVT testing using a micropiston to maintain, increase, or decrease the pressure of a fluid sample being tested in the sampling system 42 while fluid properties such as the optical density of the fluid are measured. By monitoring the fluid properties as the pressure changes, the phase envelope boundaries may be identified.

In one example, the sampling system 42 may collect and analyze a small sample with equipment with a small interior volume allows for precise control and rigorous observation when the equipment is appropriately tailored for measurement, as described by Application No. PCT/US2014/015467, which, as noted above, is incorporated by reference herein in its entirety for any purpose. At elevated temperatures and pressures, the equipment may also be configured for effective operation over a wide temperature range and at high pressures. Selecting a small size for the equipment may permit rugged operation because the heat transfer and pressure control dynamics of a smaller volume of fluid are easier to control than those of large volumes of liquids. That is, a system with a small exterior volume may be selected for use in a modular oil field services device for use within a wellbore. A small total interior volume can also allow cleaning and sample exchange to occur more quickly than in systems with larger volumes, larger surface areas, and larger amounts of dead spaces. Cleaning and sample exchange are processes that may influence the reliability of the phase transition cell. That is, the smaller volume uses less fluid for observation, but also can provide results that are more likely to be accurate.

The sampling system 42 may measure the saturation pressure of a representative reservoir fluid sample at the reservoir temperature. In a surface measurement, the reservoir phase envelope may be obtained by measuring the saturation pressure (bubble point or dewpoint pressures) of the sample using a laboratory-based pressure-volume-temperature (PVT) view cell over a range of temperatures. At each temperature, the pressure of a reservoir sample is lowered while the sample is agitated with a mixer. This is done in a view cell until bubbles or condensate droplets are optically observed and is known as a Constant Composition Expansion (CCE). The PVT view cell volume is on the order of tens to hundreds of milliliters, thus using a large volume of reservoir sample to be collected for analysis. This sample can be consumed or altered during PVT measurements. A similar volume may be used for each additional measurement, such as density and viscosity, in a surface laboratory. By contrast, the sampling system 42 may use a small volume of fluid used by microfluidic sensors (e.g., approximately 1 milliliter total for the measurements described herein) to make measurements.

In one or more embodiments, an optical phase transition cell may be included in the sampling system 42. It may be positioned in the fluid path line to subject the fluid to optical interrogation to determine the phase change properties and its optical properties. U.S. patent application Ser. No. 13/403,989, filed on Feb. 24, 2012 and United States Patent Application Publication Number 2010/0265492, published on Oct. 21, 2010 describe embodiments of a phase transition cell and its operation. Both of these applications are incorporated by reference herein for any purpose in their entirety. The pressure-volume-temperature phase transition cell may contain as little as 300 μl of fluid. The phase transition cell detects the dew point or bubble point phase change to identify the saturation pressure while simultaneously nucleating the minority phase.

The phase transition cell may provide thermal nucleation which facilitates an accurate saturation pressure measurement with a rapid depressurization rate of from about 10 to about 100 psi/second. As such, a saturation pressure measurement (including depressurization from reservoir pressure to saturation pressure) may take place in less than 10 minutes, as compared to the saturation pressure measurement via standard techniques in a surface laboratory, wherein the same measurement may take several hours. Some embodiments may include a view cell to measure the reservoir asphaltene onset pressure (AOP), wax appearance temperature (WAT), as well as the saturation pressure (PSAT) phase envelopes. Hence, the phase transition cell becomes a configuration to facilitate the measurement of many types of phase transitions.

Moreover, in one or more embodiments, a densitometer, a viscometer, a pressure gauge and/or a method to control the sample pressure with a phase transition cell may be integrated so that most sensors and control elements operate simultaneously to fully characterize a live fluid's saturation pressure. In some embodiments, each individual sensor itself has an internal volume of no more than 20 microliters (approximately 2 drops of liquid) and by connecting each in series, the total volume (500 microliters) to charge the system with live oil before each measurement may be minimized. In some embodiments, the fluid has a total fluid volume of about 1.0 mL or less. In other embodiments, the fluid has a total fluid volume of about 0.5 mL or less.

A micropiston or piston (e.g., a sapphire piston) may control the pressure within the PVT-testing component of the sampling system 42. In such an embodiment, the control of the pressure in the system may be adjusted by moving the piston to change the volume inside the piston housing and, thus, the sample volume. The PVT-testing component of the sampling system 42 may have a relatively small dead volume (e.g., less than 0.5 mL) to facilitate pressure control and sample exchange. In some embodiments, the depressurization or pressurization rate of the fluid may be less than 100 psi/second. In some embodiments, the fluid is circulated through the system at a volumetric rate of no more than 1 ml/sec. Teflon, alumina, ceramic, zirconia or metal with seals may be selected for some components for various embodiments of the pressure control device. Smooth hard surfaces may be used to minimize friction of the moving piston and both energized and dynamic seals may be used.

Using the PVT-testing component of the sampling system 42, temperature and pressure measurements for phase envelopes of the formation fluids 50 may be obtained. In general, the temperature of the fluids analyzed by the PVT-testing component of the sampling system 42 may be substantially ambient to the depth of the wellbore 14. Thus, in general, the deeper the downhole acquisition tool 12, the higher the temperature. The PVT-testing component of the sampling system 42 thus may be used to obtain temperature and pressure measurements of the phase envelopes of the formation fluids 50 at different temperatures by moving the downhole tool 12 to different depths and obtaining new phase envelope measurements at the different temperatures at those depths. This may allow the downhole acquisition tool 12 to obtain a more complete set of temperature and pressure data points that describe the phase envelopes of the formation fluids 50. Additionally or alternatively, multi-temperature phase-envelope measurements of mixtures of formation fluids collected at different stations may be tested in-situ. Some examples of mixing and testing formation fluids appear in U.S. patent application Ser. No. 14/975,698, "Systems and Methods for In-Situ Measurements of Mixed Formation Fluids," which is incorporated by reference in its entirety for any purpose.

Figure 4:
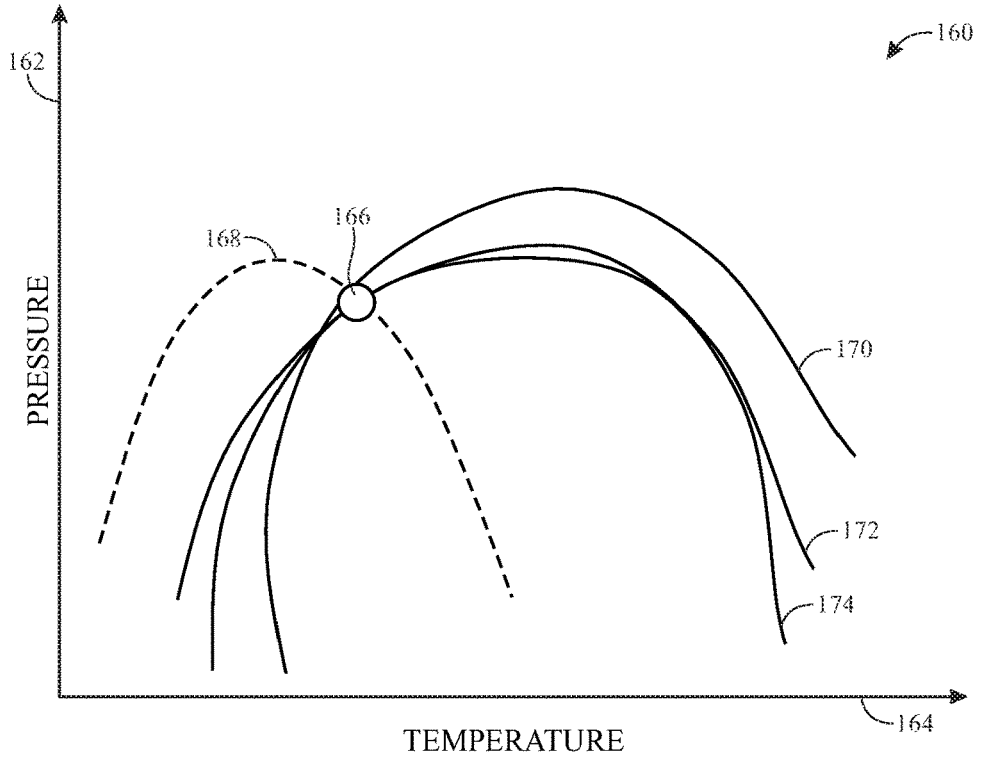
FIG. 4 is a plot showing potential phase envelopes in a phase diagram for saturation pressure (PSAT) when only a single saturation pressure point has been identified.

When the sampling system 42 tests the formation fluid 50 in-situ to ascertain properties indicative of a phase envelope (e.g., AOP, PSAT, WAT, etc.), the temperature being tested may be generally close to the ambient temperature of the wellbore 14 at the current depth of testing. An example of a single data point for a phase envelope boundary is shown by a plot 160 of FIG. 4. The plot 160 describes phase behavior of the formation fluid 50 at various pressures (ordinate 162) and temperatures (abscissa 164). The plot 160 includes a single data point 166 that corresponds to a measured saturation pressure (PSAT) point obtained by the sampling system 42 at one particular temperature (and, thus, at one particular depth). With just one data point 166, the phase behavior of the formation fluid 50 may be accurately modeled for that particular temperature. Yet there may be a very large number of potential PSAT phase envelopes that could pass through the data point 166. Indeed, there may be one true phase envelope 168 that would most accurately describe the phase behavior of the formation fluid 50, but it may be very difficult to distinguish the true phase envelope 168 from other potential phase envelopes—some examples of which are shown by curves 170, 172, and 174—with just the single data point 166.

Figure 5:
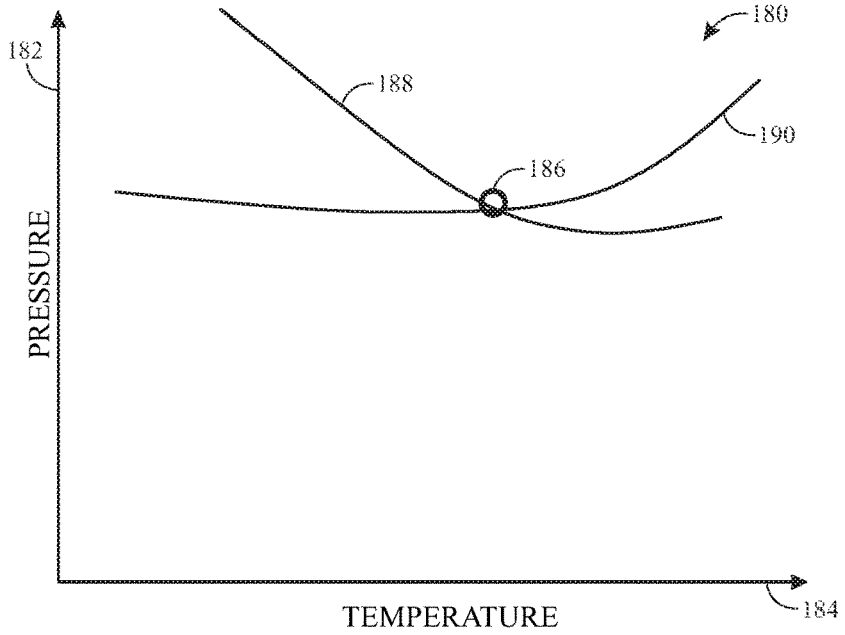
FIG. 5 is a plot showing potential phase envelopes in a phase diagram for asphaltene onset pressure (AOP) when only a single pressure point has been identified.

A plot 180 of FIG. 5 also describes phase behavior of the formation fluid 50 at various pressures (ordinate 182) and temperatures (abscissa 184). The plot 180 includes a single data point 186 that corresponds to a measured asphaltene onset pressure (AOP) point obtained by the sampling system 42 at one particular temperature (and, thus, at one particular depth). With just one data point 186, the phase behavior of the formation fluid 50 may be accurately modeled for that particular temperature. Y et there may also be a very large number of potential AOP phase envelopes that could pass through the data point 186. Indeed, there may be one true phase envelope 188 that would most accurately describe the phase behavior of the formation fluid 50, but it may be very difficult to distinguish the true phase envelope 188 from other potential phase envelopes—one example of which are shown by curve 190—with just the single data point 186.

Figure 6:
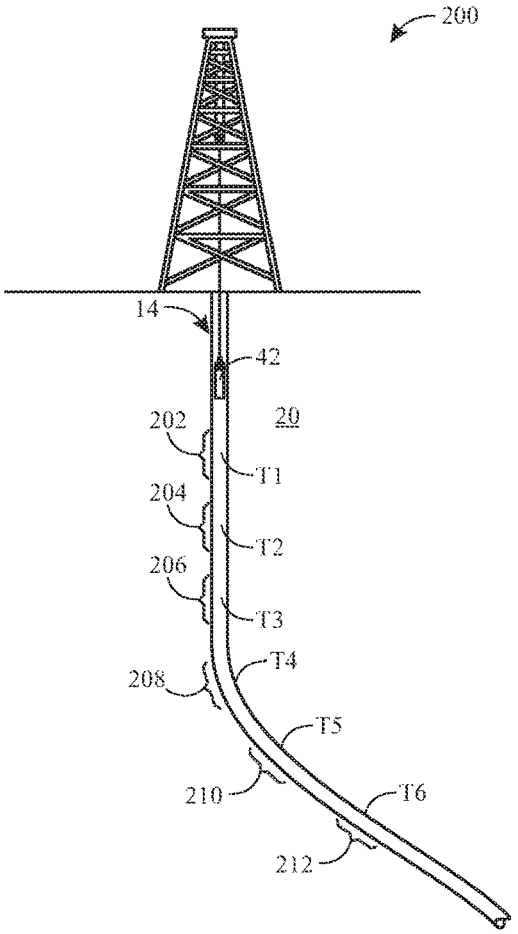
FIG. 6 is a schematic diagram of variations in temperature and pressure throughout the depth of the wellbore, in accordance with an embodiment.

The potential deficiencies of obtaining just one phase-envelope measurement at one temperature may be remedied by performing phase-envelope testing in the sampling system 42 using multiple temperatures from a corresponding number of depths. Indeed, as shown by a wellsite diagram 200 in FIG. 6, the ambient temperature of the sampling system 42 may vary with the depth of the wellbore 14. Indeed, a first depth 202 may have a first ambient temperature T1, a second depth 204 may have a second ambient temperature T2, a third depth 206 may have a second ambient temperature T3, a fourth depth 208 may have a fourth ambient temperature T4, a fifth depth 210 may have a fifth ambient temperature T5, and a sixth depth 212 may have a sixth ambient temperature T6, and so forth. In general, the deeper the location in the wellbore 14, the higher the temperature. In the example of FIG. 6, the temperatures may have a relationship in which T6>T5>T4>T3>T2>T1. The variations in temperature by depth may allow the sampling system 42 to obtain multiple phase-envelope measurements—as well as measurements of other fluid properties, such as viscosity—at a variety of temperatures (e.g., T1, T2, T3, T4, T5, T6) by performing phase-envelope measurements on a sample of formation fluid 50 at different depths (e.g., 202, 204, 206, 208, 210, 212).

Figure 7:
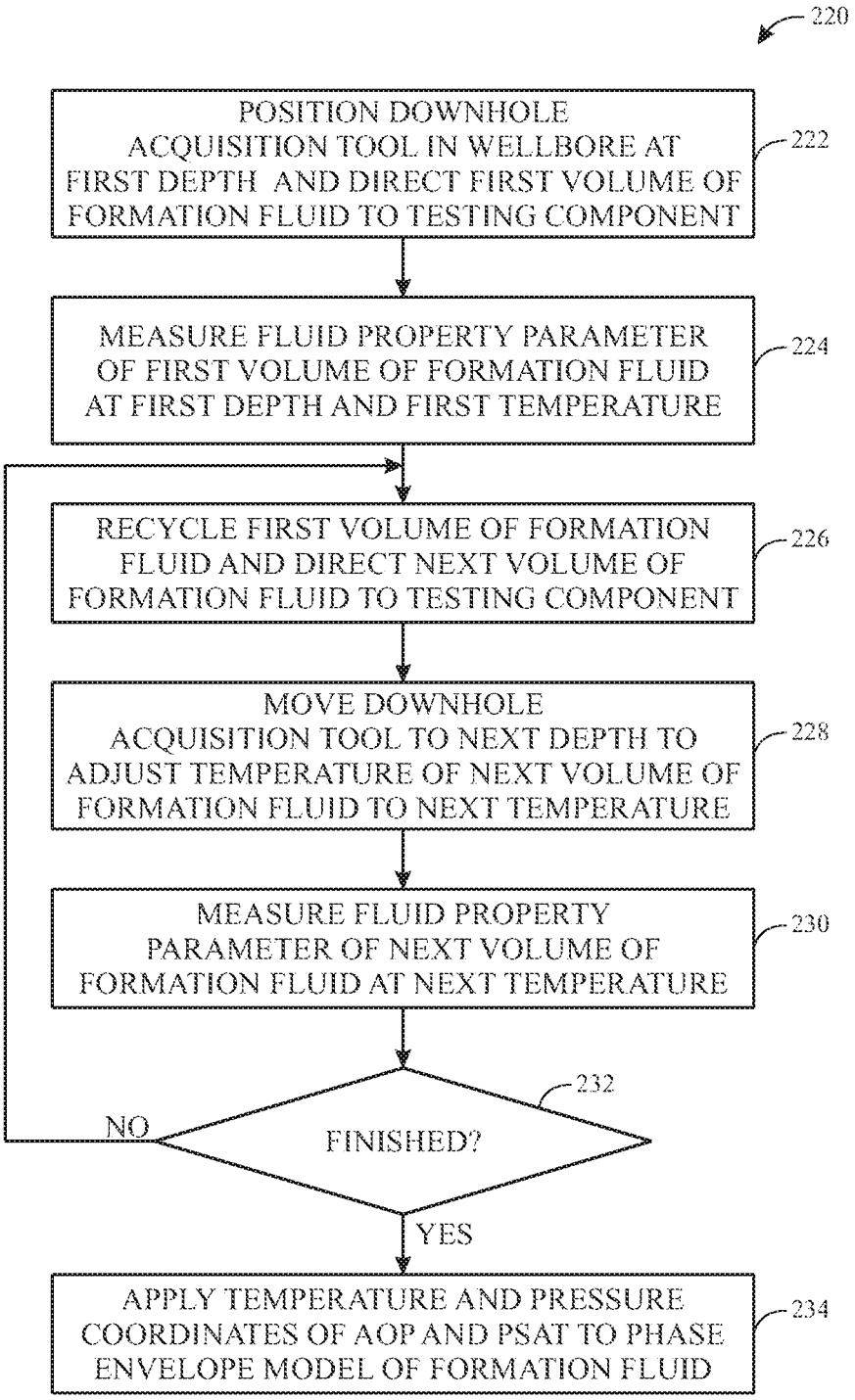
FIG. 7 is a flowchart of a method for identifying multiple points of a phase envelope (e.g., saturation pressure or asphaltene onset pressure) of a formation fluid, in accordance with an embodiment.

For example, as shown by a flowchart 220 of FIG. 7, a downhole acquisition tool 12 or downhole acquisition tool 100 having the sampling system 42 may be positioned in the wellbore 14. After obtaining one or more samples at one or more depths, a first part of at least one of the samples of formation fluid 50 may tested to obtain one or more phase-envelope data points or other fluid property (e.g., viscosity) at a first depth (block 222). For example, the first depth may be the depth 202 and the temperature may be a temperature value T1. The sampling system 42 may direct a first volume of formation fluid 50 from a first sample stored in the sampling system 42 to a PVT-testing component to measure a fluid property parameter such as saturation pressure (PSAT) (block 224). As a result, the sampling system 42 may identify the PSAT phase envelope boundary for the particular temperature of the depth (e.g., at temperature T1). While remaining at the first depth and temperature T1, the sampling system 42 may continue to measure fluid properties of other fluid samples (block 226). For example, while remaining at the first depth and temperature T1, the sampling system 42 may test a first sample that was originally obtained at the first fluid zone 51A, and may subsequently test a second sample that was originally obtained at the second fluid zone 51B, before moving on to another depth. It should be appreciated that, as mentioned above, testing different samples of formation fluids 50 individually does not preclude also testing some mixture of the different samples of formation fluids 50 in the manner described by U.S. patent application Ser. No. 14/975,698, "Systems and Methods for In-Situ Measurements of Mixed Formation Fluids."

Having obtained desired measurements for one or more samples of formation fluid 50 at the first depth/temperature (e.g., temperature T1 at depth 202), the sampling system 42 may move to another depth, where the sampling system 42 may be stationed for some period of time (e.g., 204) (block 228). Moving to the next depth may have the effect of adjusting the ambient temperature of the sampling system 42 (e.g., to temperature T2) over the period of time. At this next depth and temperature (e.g., temperature T2 at depth 204), another part of the first sample of formation fluid 50 may tested to obtain one or more phase-envelope data points or other fluid property (e.g., viscosity) at the next depth (block 230). Until the sampling system 42 is finished collecting measurements of fluid properties (decision block 232), the sampling system 42 may continue to collect such fluid property measurements of the different samples or mixtures of samples at different depths and temperatures (e.g., temperature T3 at depth 206, temperature T4 at depth 208, temperature T5 at depth 210, temperature T6 at depth 212, and so forth). Having obtained data points at many different depths and, accordingly, temperatures, the data points may be used to model the phase envelopes of the formation fluids 50 (decision block 234). For example, a phase diagram may be generated or the formation fluids 50 may be more accurately modeled in one or more equations of state (EOS) of the formation fluids 50 and/or the reservoir as a whole.

Figure 8:
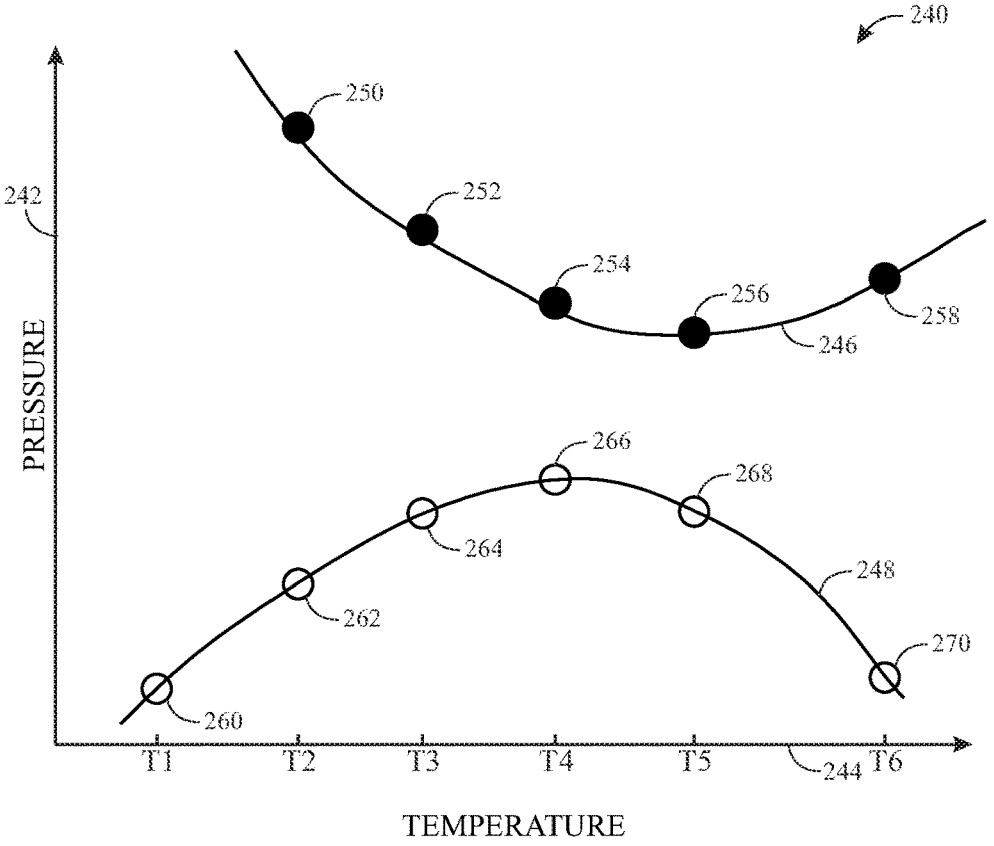
FIG. 8 is a simulated phase diagram of formation fluid having phase envelope models constrained to the data points obtained using the method of FIG. 7, in accordance with an embodiment.

A plot 240 of FIG. 8 represents one example of a phase diagram of a sample of formation fluid 50 that may be more accurately modeled by obtaining multiple temperature/pressure data points by obtaining the measurements at multiple depths. The plot 240 describes phase behavior of one sample of formation fluid 50 at various pressures (ordinate 242) and temperatures (abscissa 244), as measured in-situ by the sampling system 42. The plot 240 may more accurately identify a likely asphaltene onset pressure (AOP) phase envelope 246 and a saturation pressure (PSAT) phase envelope 248. This is because the plot 240 includes multiple data points 250, 252, 254, 256, and 258 that correspond to a measured AOP value obtained by the sampling system 42 at particular respective depths/temperatures (e.g., T2, T3, T4, T5, and T6). The plot 240 also includes multiple data points 260, 262, 264, 266, 268, and 270 that correspond to a measured PSAT value obtained by the sampling system 42 at particular respective depths/temperatures (e.g., T1, T2, T3, T4, T5, and T6). The AOP phase envelope 246 and the PSAT phase envelope 248 may be estimated by fitting a curve through the multiple measured data points.

Figure 9:
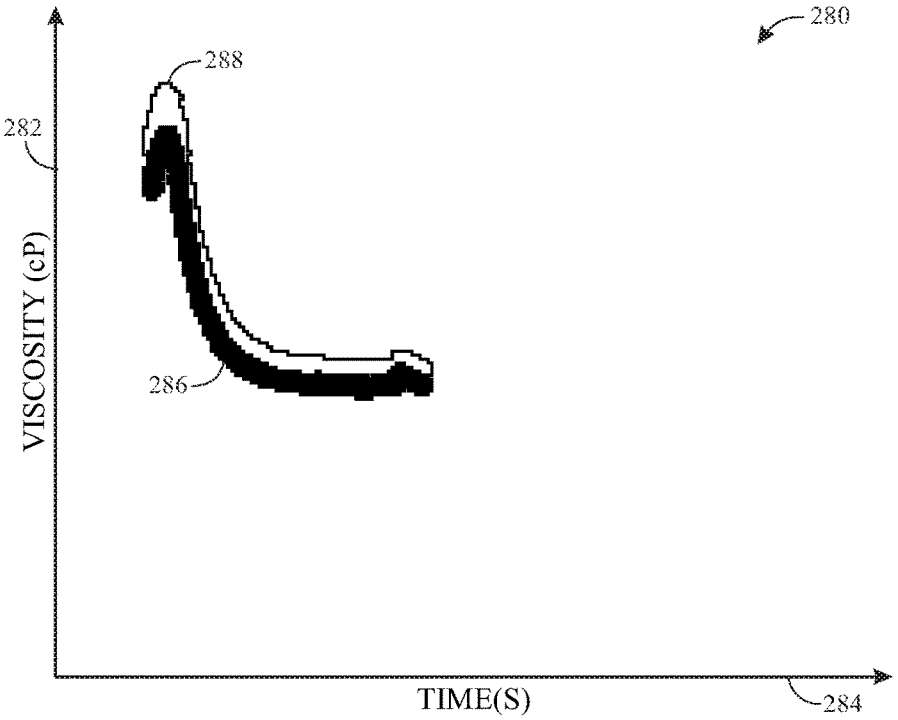
FIG. 9 is a plot showing that other properties, such as viscosity, may also be identified at various temperatures in accordance with the systems and methods of this disclosure.

As mentioned above, the systems and methods of this disclosure are not limited to obtaining phase envelope measurements at multiple depths/temperatures. Indeed, other fluid properties that vary with temperature may be more accurately identified by measuring them at multiple depths/temperatures. For instance, a plot 280 of FIG. 9 compares a measurement of fluid viscosity (ordinate 282) in relation to a period of time (abscissa 284) during which the sampling system 42 is moved deeper into the wellbore and, thus, into higher ambient temperatures. In the particular example of FIG. 9, the fluid being measured is J13 hydraulic oil (priming liquid), but FIG. 9 is intended to show that measurements of viscosity of an oleic fluid (e.g., formation fluid 50) may be obtained at multiple depths/temperatures downhole. Here, a first curve 286 represents viscosity of a first sample of the hydraulic oil as measured in a first viscosity-measuring component of the sampling system 42 and a second curve 288 represents viscosity of a second sample of the hydraulic oil as measured in a second viscosity-measuring component of the sampling system 42. The viscosity may be seen to drop according to a defined function in relation to temperature, since over time, the sampling system 42 is moving deeper into the wellbore 14 and, accordingly, into higher temperatures.

Thus, measurements of the viscosity of samples of the formation fluids 50, likewise, may be obtained at multiple depths and temperatures. This may allow the sampling system 42 to obtain data points relating viscosity of the formation fluid 50 over a range of temperatures. This may further allow the formation fluids 50 to be more accurately modeled in one or more equations of state (EOS) of the formation fluids 50 and/or the reservoir as a whole. Furthermore, it should be appreciated that the systems and methods of this disclosure may also be used with other temperature-dependent properties of the formation fluid 50, which may also include density, compressibility, opacity, and so forth.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A method comprising:

obtaining a sample of a first formation fluid using a downhole acquisition tool positioned in a wellbore in a geological formation;

testing the sample of the first formation fluid for an amount of contamination present in the sample of the of the first formation fluid using the downhole acquisition tool;

determining that the amount of the contamination present in the sample of the first formation fluid is below a threshold level using the downhole acquisition tool;

stationing the downhole acquisition tool at a first depth in the wellbore in response to determining that the amount of the contamination present in the sample of the first formation fluid being below the threshold level, wherein the first depth has an ambient first temperature;

testing a first part of the sample of the first formation fluid using a pressure-volume-temperature tester in the downhole acquisition tool while the downhole acquisition tool is stationed at the first depth to obtain a first measurement point, such that the first part of the sample of the first formation fluid is tested at approximately the first temperature, wherein a densitometer, a viscometer, and a pressure gauge are integrated with the pressure-volume-temperature tester and operate simultaneously with each other and control equipment to characterize the first part of the sample of the first formation fluid, and to control a piston to control pressure in the pressure-volume-temperature tester by controlling the piston, wherein as the piston in the pressure-volume-temperature tester is moved to vary the pressure the densitometer, the viscometer, and the pressure gauge operate simultaneously with each other to determine at least one of saturation pressure at the first temperature, asphaltene onset pressure at the first temperature, a wax appearance temperature at the first temperature of the first part of the sample of the first formation fluid;

directing a second part of the sample of the first formation fluid of fluid to the pressure-volume-temperature tester and moving the downhole acquisition tool to a second depth;

stationing the downhole acquisition tool at the second depth in the wellbore, wherein the second depth has an ambient second temperature different from the first temperature;

testing the second part of the sample of the first formation fluid using the pressure-volume-temperature tester in the downhole acquisition tool while the downhole acquisition tool is stationed at the second depth to obtain a second measurement point, such that the second part of the sample of the first formation fluid is tested at approximately the second temperature wherein a densitometer, a viscometer, and a pressure gauge are integrated with the pressure-volume-temperature tester and operate simultaneously as a piston in the pressure-volume-temperature tester is moved to vary the pressure to determine at least one of saturation pressure at the second temperature, asphaltene onset pressure at the second temperature, a wax appearance temperature at the second temperature of the second part of the sample of the first formation fluid; and determining a temperature and pressure-dependent relationship of a first fluid property of the first formation fluid based on the first measurement point and the second measurement point.

2. The method of claim 1, comprises a further comprising measuring the viscosity of the first part of the sample of reservoir fluid at the first temperature and of the second part of the sample of reservoir fluid at the second temperature.

3. The method of claim 1, wherein determining the temperature and pressure-dependent relationship of the first fluid property of the first formation fluid comprises determining a model of a phase envelope of the first formation fluid.

4. The method of claim 1, comprising:

obtaining a sample of second formation fluid using the downhole acquisition tool positioned in the wellbore in the geological formation, wherein the sample of the first formation fluid is obtained from a first fluid zone in the wellbore and the second formation fluid is obtained from a second fluid zone in the wellbore;

testing the first fluid property of a first part of the sample of the second formation fluid using the downhole acquisition tool while the downhole acquisition tool is stationed at the first depth to obtain a third measurement point, such that the first part of the sample of the second formation fluid is tested at approximately the first temperature;

testing the first fluid property of a second part of the sample of the second formation fluid using the downhole acquisition tool while the downhole acquisition tool is stationed at the second depth to obtain a fourth measurement point, such that the second part of the sample of the second formation fluid is tested at approximately the second temperature; and determining a temperature-dependent relationship of the first fluid property of the second formation fluid based on the third measurement point and the fourth measurement point.

5. The method of claim 4, wherein the first fluid zone is hydraulically isolated from the second fluid zone.

6. The method of claim 1, comprising repeating stationing the downhole acquisition tool at subsequent depths and testing the first fluid property of subsequent parts of the sample of the first formation fluid at the subsequent depths until a total number of measurement points is obtained, wherein the number of measurement points is at least three.

7. The method of claim 1, comprising:

testing a second fluid property of the first part of the sample of the first formation fluid using the downhole acquisition tool while the downhole acquisition tool is stationed at the first depth to obtain a third measurement point, such that the first part of the sample of the first formation fluid is tested at approximately the first temperature;

testing the second fluid property of the second part of the sample of the first formation fluid using the downhole acquisition tool while the downhole acquisition tool is stationed at the second depth to obtain a fourth measurement point, such that the second part of the sample of the first formation fluid is tested at approximately the second temperature; and determining a temperature-dependent relationship of the second fluid property of the first formation fluid based on the third measurement point and the fourth measurement point.

8. The method of claim 7, wherein the first fluid property comprises a saturation pressure, the second fluid property comprises an asphaltene onset pressure, the temperature-dependent relationship of the first fluid property of the first formation fluid comprises a phase envelope of the saturation pressure, and the temperature-dependent relationship of the second fluid property of the first formation fluid comprises a phase envelope of the asphaltene onset pressure.

* * * * *